US009200481B2

(12) United States Patent
Walther

(10) Patent No.: US 9,200,481 B2
(45) Date of Patent: Dec. 1, 2015

(54) LOW PROFILE SECURITY SYSTEM FOR CANINE ENTRY AND EXIT

(71) Applicant: Michael A Walther, Phoenix, AZ (US)

(72) Inventor: Michael A Walther, Phoenix, AZ (US)

( * ) Notice: Subject to any disclaimer, the term of this patent is extended or adjusted under 35 U.S.C. 154(b) by 0 days.

(21) Appl. No.: 13/815,264

(22) Filed: Feb. 14, 2013

(65) Prior Publication Data

US 2014/0033639 A1 Feb. 6, 2014

Related U.S. Application Data

(60) Provisional application No. 61/742,010, filed on Aug. 1, 2012.

(51) Int. Cl.

| | |
|---|---|
| ***E06B 7/32*** | (2006.01) |
| ***E06B 7/00*** | (2006.01) |
| ***E06B 1/52*** | (2006.01) |

(52) U.S. Cl.

CPC ... *E06B 7/32* (2013.01); *E06B 1/52* (2013.01); *E06B 7/00* (2013.01)

(58) Field of Classification Search

CPC ..... E06B 7/32; E06B 7/28; E06B 7/00; E06B 1/52

USPC ..... 52/745.15, 745.16, 656.4, 204.1

See application file for complete search history.

(56) References Cited

U.S. PATENT DOCUMENTS

| | | | | | |
|---|---|---|---|---|---|
| 1,186,565 | A * | 6/1916 | Fogg | 49/169 |
| 1,581,776 | A * | 4/1926 | Altschul | 211/4 |
| 1,859,974 | A * | 5/1932 | Kroenke | 160/97 |
| 5,365,706 | A * | 11/1994 | Elsenpeter et al. | 52/204.1 |
| 5,850,710 | A * | 12/1998 | Brock | 49/141 |
| 6,151,848 | A * | 11/2000 | Hunter | 52/205 |
| 6,745,515 | B1 * | 6/2004 | Chen | 49/169 |
| 2004/0118049 | A1 * | 6/2004 | Chen | 49/169 |
| 2005/0284091 | A1 * | 12/2005 | Sales | 52/745.15 |
| 2006/0156512 | A1 * | 7/2006 | Naylor | 16/273 |

* cited by examiner

*Primary Examiner* — Brian Glessner
*Assistant Examiner* — Jessie Fonseca
(74) *Attorney, Agent, or Firm* — Tod R. Nissle, P.C.

(57) ABSTRACT

A method to provide in a wall of a building structure a low-profile secure canine access comprises the steps of forming an access opening through the wall, mounting a door structure in the wall, and installing a supplemental security member over the door structure to fully enclose the door structure. A door is mounted in the security member. A low profile locking system secures the door in a closed position.

2 Claims, 5 Drawing Sheets

LOW PROFILE SECURITY SYSTEM FOR CANINE ENTRY AND EXIT

This application claims priority based on provisional patent application Ser. No. 61/742,010, filed Aug. 1, 2012.

This invention relates to security systems.

More particularly, the invention relates to low profile security system for canine entry and exit and method to install the same.

Those of skill in the art have long endeavored to provide improved security systems. Accordingly, it would be highly desirable to provide an improved security system.

Therefore, it is a principal object of the instant invention to provide an improved security system.

More particularly, it is an object of the invention to provide an improved security system for canine entry and exit into a building structure.

These, and other and further objects of the invention will be apparent to those of skill in the art from the following detailed description thereof, taken in conjunction with the drawings, in which.

Figure 1:
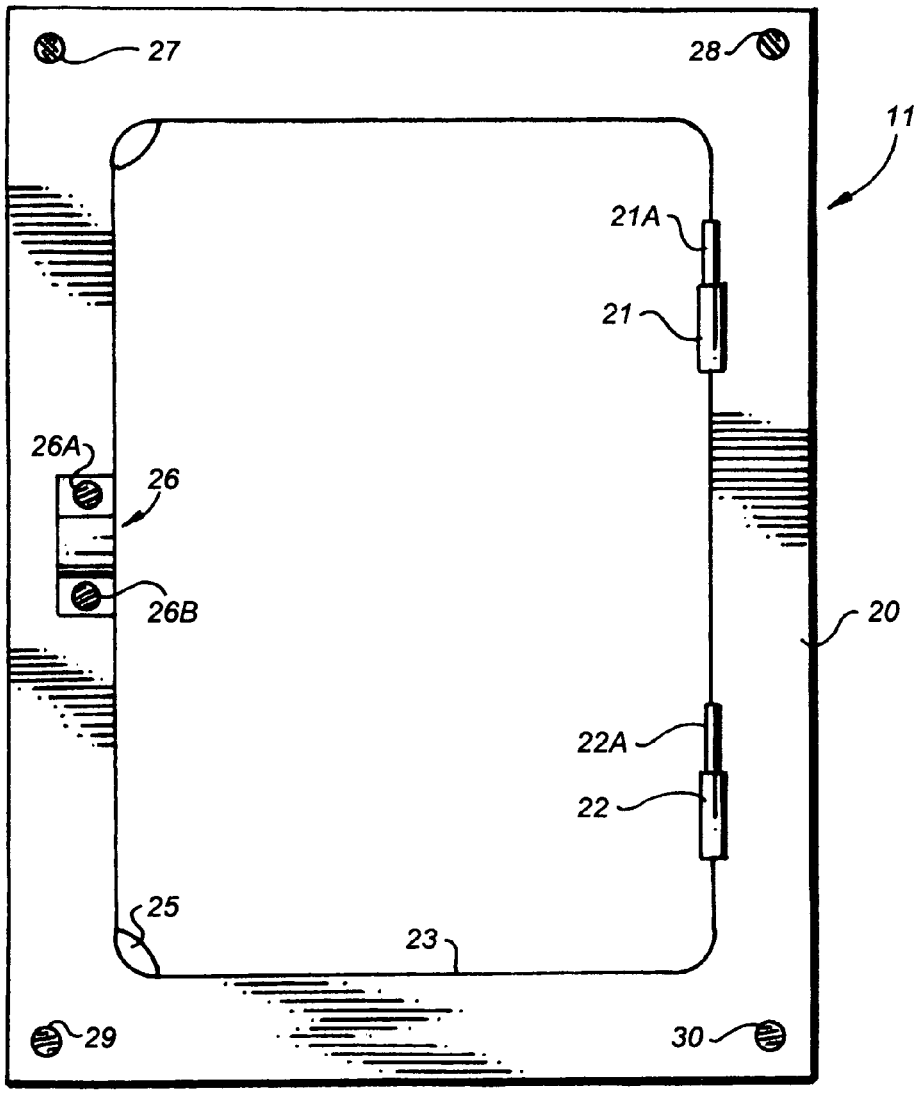
FIG. 1 is a front view illustrating an orthogonal security member constructed in accordance with the principles of the invention.

Briefly, in accordance with the invention, provided is a method to provide in a wall of a building structure a low-profile secure canine access, the wall including a vertically oriented exterior face and a vertically oriented interior face. The method comprising the step of forming an access opening through the wall, the opening extending from the exterior face through the wall to the interior face; and, providing a door structure mountable in the opening in the wall. The door structure includes at least one side sized to extend at least partially through the opening from the exterior face to the interior face; and, includes a flange connected to the side and shaped and dimensioned to extend substantially around the opening over a portion of the exterior face of the wall adjacent the opening. The flange has a selected thickness such that the flange projects a selected distance outwardly from the exterior face of the wall The method also comprises the step of providing a first security member. The first security member is shaped and dimensioned to fit over the flange and includes a generally orthogonal frame panel having a peripheral edge; and, includes a generally orthogonal door opening formed through the frame panel. The door opening includes a top, a bottom, a first side, and a second side.

The first security member also comprises at least a pair of spaced apart security hinges each including a base fixedly secured to the frame panel at the first side of the opening, and including a hinge joint attached to and outwardly projecting from the base and spaced apart from the frame panel.

The first security member also includes a low profile bolt receiver fixedly mounted on the frame panel at the second side of the opening; and, includes an outwardly extending edge extending substantially the entire distance around the peripheral edge of the frame panel, The edge has a width generally equivalent to the thickness of the flange and has a distal lip spaced apart from the frame panel.

The method of the invention also comprises the step of providing a second security member. The second security member comprises a generally orthogonal door panel shaped and dimensioned to fit in the door opening; and, comprises at least a pair of spaced apart hollow security hinge members each operatively associated with a different one of the security hinges, each fixedly secured to the door panel, and each shaped and dimensioned to slide rotatably downwardly over a different one of the hinge joints and substantially completely cover and enclose the hinge joint.

The second security member also comprises a low profile latch assembly including a housing; and, a bolt slidably encased in the housing. The bolt has a distal end and is shaped and dimensioned such that the distal end freely slides into and out of the bolt receiver. The bolt moves between at least two operative positions, a first operative position in which the distal end is positioned in the bolt receiver and the door panel is locked in a closed position, and a second operative position in which the distal end is positioned out of the bolt receiver and the door panel can freely pivot on the hinge joints to an open position. The latch assembly also includes a self contained manually operable locking mechanism to lock the bolt in the first operative position.

The method of the invention further comprises the steps of mounting the door structure in the door opening with the flange adjacent and contacting the exterior face of the wall; and, mounting the first security member on the exterior face of the wall with the frame panel extending over the flange, with the lip circumscribing the flange and adjacent and contacting the exterior face of the wall, and with the door opening generally in registration with a portion of the access opening.

The method of the invention further comprises the steps of mounting the second security member on the first security member by sliding the security hinge members over the hinge joints; closing the door panel by pivoting the door panel on the hinge joints to move the door panel into registration with the door opening; manually operating the latch assembly to move the bolt into the first operative position; and, manually operating the locking mechanism to lock the bolt in the first operative position.

Figure 4:
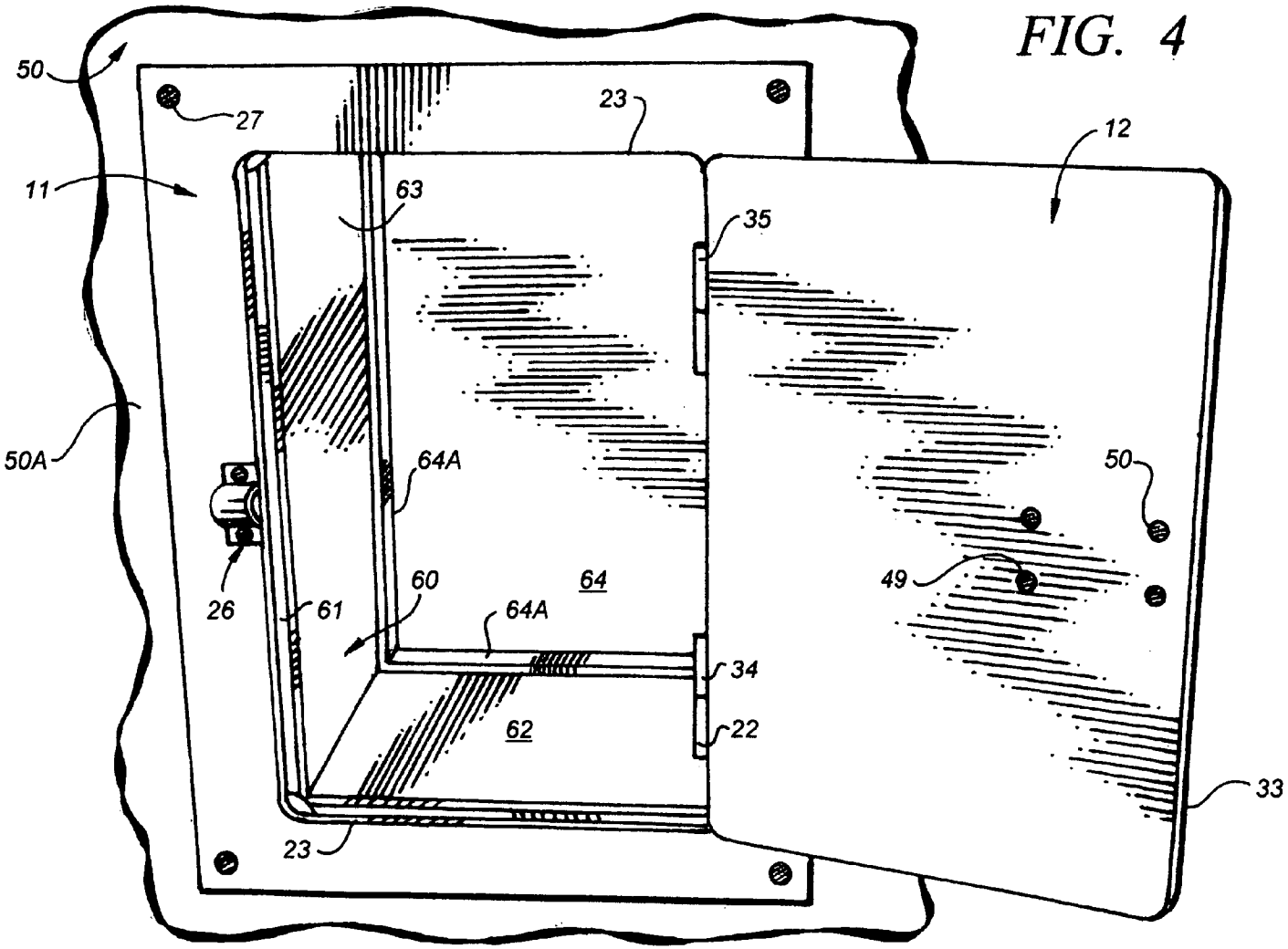
FIG. 4 is a front perspective view illustrating the security member and door panel of FIG. 3 mounted on the exterior of a wall with the door panel in an open operative position; and, FIG. 5 is a section view of the security member and door panel of FIG. 3 mounted in the wall of FIG. 4 with the door panel in a closed operative position.
Figure 5:
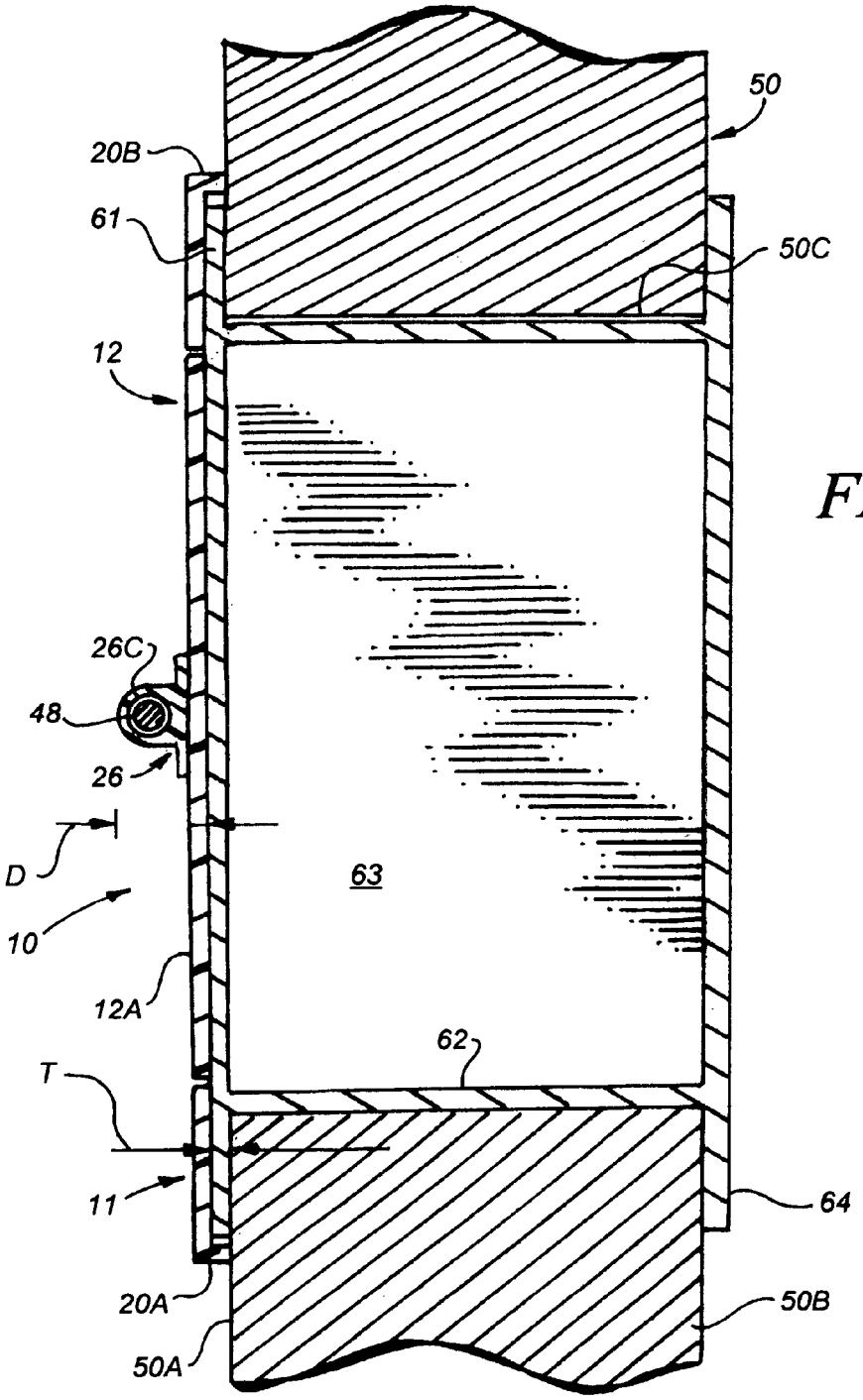

Turning now to the drawings which are provided by way of example and not limitation and in which like reference characters refer to corresponding elements throughout the several views, the apparatus set forth in the drawings is described with reference to preferred methods in accordance with the invention. A preferred method comprises providing a wall 50 (FIGS. 4 and 5) of a building structure a low-profile secure canine access (or an access for some other animal), the wall 50 including a vertically oriented exterior face 50A and a vertically oriented interior face 50B (FIGS. 4 and 5). The method comprises the step of forming an access opening 50C through the wall, the opening extending from the exterior face 50A through the wall to the interior face 50B. The method also comprises the step of providing a door structure mountable in the opening in the wall.

The door structure includes at least one side 63 sized to extend at least partially through opening 50C from the exterior face 50A to the interior face 50B, and includes a flange 61 connected to side 63 and shaped and dimensioned to extend substantially completely around the opening 50C over a portion of the exterior face 50A of the wall adjacent the opening 50C. The flange 61 has a selected thickness such that said flange projects a selected distance outwardly from the exterior face 50A of the wall 50. In an alternate embodiment of the invention, the flange 61 extends over the interior face 50B the wall.

The method also comprises the step of providing a first security member 11 shaped and dimensioned to fit over the flange 61. Security member 11 includes a generally orthogonal frame panel 20 having a peripheral edge, and includes a generally orthogonal door opening 23 formed through the frame panel 20. The door opening includes a top, a bottom, a first side, and a second side.

Security member 11 also includes at least one, preferably at least a pair, of spaced apart security hinges each including a base 21, 22 fixedly secured to the frame panel 20 at the first side of the opening 23, and each including a hinge joint 21A, 22A attached to and outwardly projecting from its associated base 21, 22, respectively, and spaced apart from the frame panel 20.

In FIG. 1 the hinges 21, 21A, 22, 22A are attached to a side of opening 23. If desired, the hinges can be attached to the bottom of opening 23 in the manner indicated by dashed lines 66 and 67 in FIG. 2. This would mean that the operatively associated hinge members 34, 35 on door panel 12 would be attached to the bottom, inside of a side, of door panel 12. Door panel 12 would then open and close in the manner of a drawbridge in a castle. In another embodiment of the invention, the hinges 21, 21A, 22, 22A are attached to the top of opening 23 and the operatively associated hinge members 34, 35 are attached to the top of door panel 12.

Security member 11 also includes a low profile bolt receiver 26 fixedly mounted on the frame panel 20 at the second side of the opening. The receiver 26 is fixedly mounted on panel 20 by rivets 26A, 26B or by other desired fastening means.

Security member 11 also includes an outwardly extending orthogonal edge 20A, 20B, 20C, 20D extending substantially the entire distance around the peripheral edge of the frame panel 20. Edge 20A, 20B, 20C, 20D has a width, indicated by arrows B in FIG. 2, generally equivalent to the thickness, indicated by arrows T in FIG. 5, of the flange 61, and has an orthogonal, peripheral distal lip 70 spaced apart from the frame panel 20.

The method also includes the step of providing a second security member. The second security member includes a generally orthogonal door panel 12 shaped and dimensioned to fit in the door opening 23, and includes at least one, preferably at least a pair, of spaced apart hollow security hinge members 34, 35 each operatively associated with a different one of the security hinges, each fixedly secured to the door panel 12, and each shaped and dimensioned to slide rotatably downwardly over a different one of the hinge joints 22A, 21A, respectively, and to substantially completely cover and enclose the hinge joint 22A, 21A.

The second security member also includes a low profile latch assembly 46 fixedly secured to door panel 12 by rivets 49, 50 or by other desired fastening mechanisms. Latch assembly 46 includes a housing, and a cylindrical bolt 48 slidably encased in the housing. The bolt 48 has a distal end and is shaped and dimensioned such that the distal end freely slides into and out of the bolt receiver 26. The bolt 48 is manually slidably movable between at least two operative positions, a first operative position in which the distal end is positioned in the bolt receiver 26 and the door panel 12 can be locked in a closed position, and a second operative position in which the distal end of bolt 48 is positioned out of the bolt receiver 26 and the door panel can freely pivot on the hinge joints to an open position. Bolt 28 is manually slid back and forth between the first and second operative positions by manually grasping handle 47 attached to bolt 48 and displacing handle 47 (and therefore bolt 48) laterally back and forth in the housing of the latch assembly 46.

Figure 3:
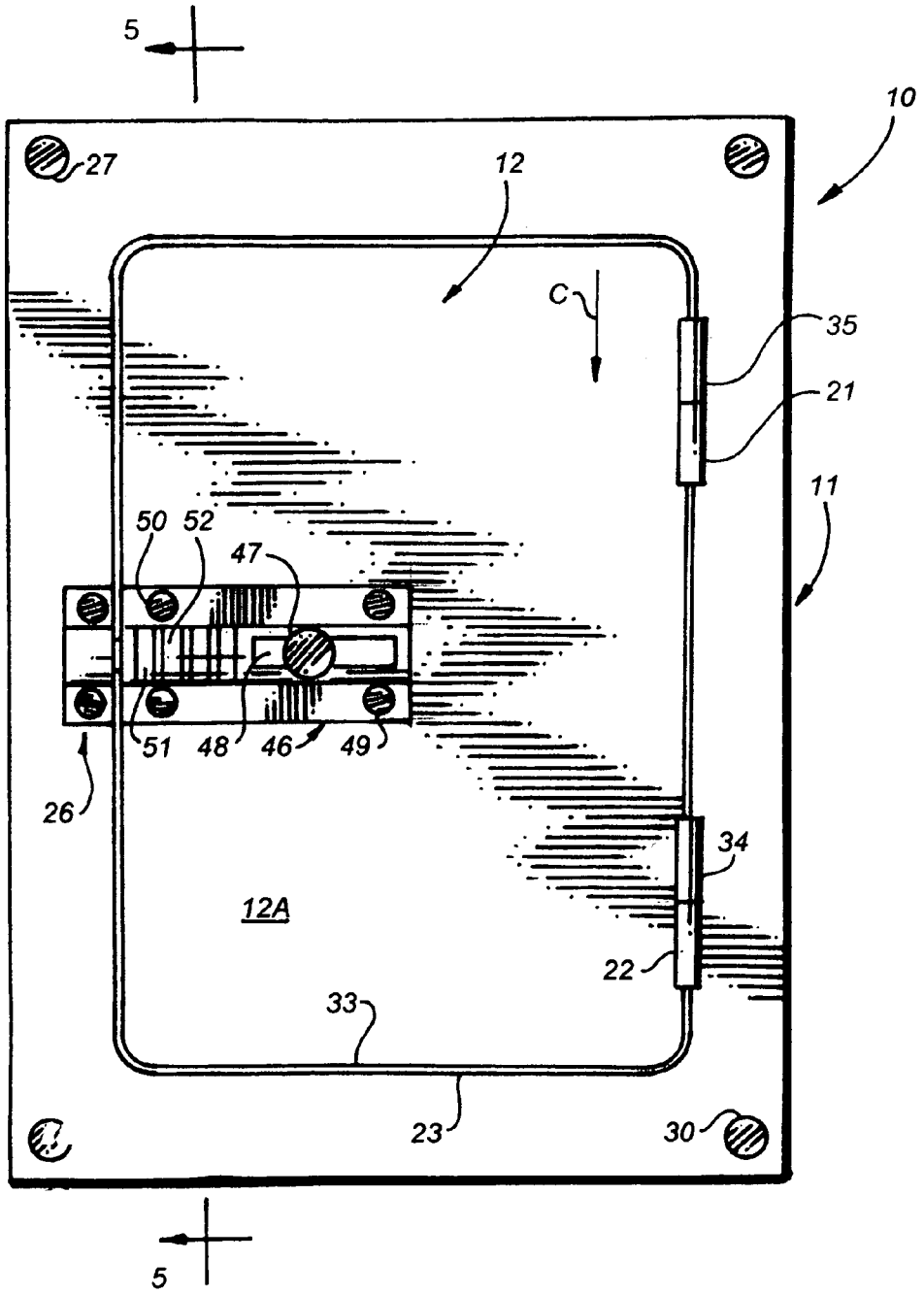
FIG. 3 is a front view illustrating the security member of FIGS. 1 and 2 with a door panel mounted therein.

The latch assembly 46 includes a self contained manually operable locking mechanism to lock (and unlock) the bolt in the first operative position. While the self contained manually operable locking mechanism can comprise a padlock (opened with a key or by manually operating rotatable tumblers built into the padlock) or other locking mechanism, the presently preferred locking mechanism is illustrated in FIG. 3 and includes a plurality of circular, spaced apart, rotatable tumblers 51, 52 with an equivalent sequence of numbers on each of the members. The sequence of numbers can be any desired sequence but is typically 1, 2, 3, 4, 5, 6, 7, 8, 9, 0. The tumblers are operated in conventional fashion, i.e., when each tumbler is rotated to a position so that a desired aligned sequence of number appears, then handle 47 can be used to freely slidably move bolt 48 laterally back-and-forth between the first and second operative positions. Conversely, if when bolt 48 is in the first operative position at least one of the tumblers is rotated to a position in which the proper number on the tumbler is not in alignment with the proper numbers on each of the other tumblers, then bolt 48 is locked in the first operative position.

The method also includes the step of mounting the door structure in the orthogonal opening 50C with the flange 61 adjacent and contacting the exterior face 50A of the wall 50. In an alternate embodiment of the invention. The door structure is mounted such that the flange 61 is adjacent and contacting the interior face 50B of wall 50. As used herein, the wall of a building structure can, if desired, include a door used by human beings to walk into and out of the building structure.

The method of the invention also includes the step of mounting the first security member on the exterior face 50A (or interior face 50B) of the wall with the frame panel 20 extending over flange 61, with the lip 70 circumscribing said flange and adjacent and contacting the exterior face 50A of the wall, and with the door opening 23 generally in registration with a portion of said access opening 50C.

The method also includes mounting the second security member on the first security member 11 by sliding the security hinge members 35, 34 downwardly over fixed hinge joints 21A, 22A, respectively; and, includes closing the door panel 12 by pivoting members 35, 34 on the hinge joints 21A, 22A to close door panel 12 and move the door panel 12 into registration with the door opening 23.

The method also comprises the steps of manually operating the latch assembly 46 to slide the bolt 48 into the first operative position; and, of manually operating the locking mechanism 46 to lock the bolt in the first operative position.

Figure 2:
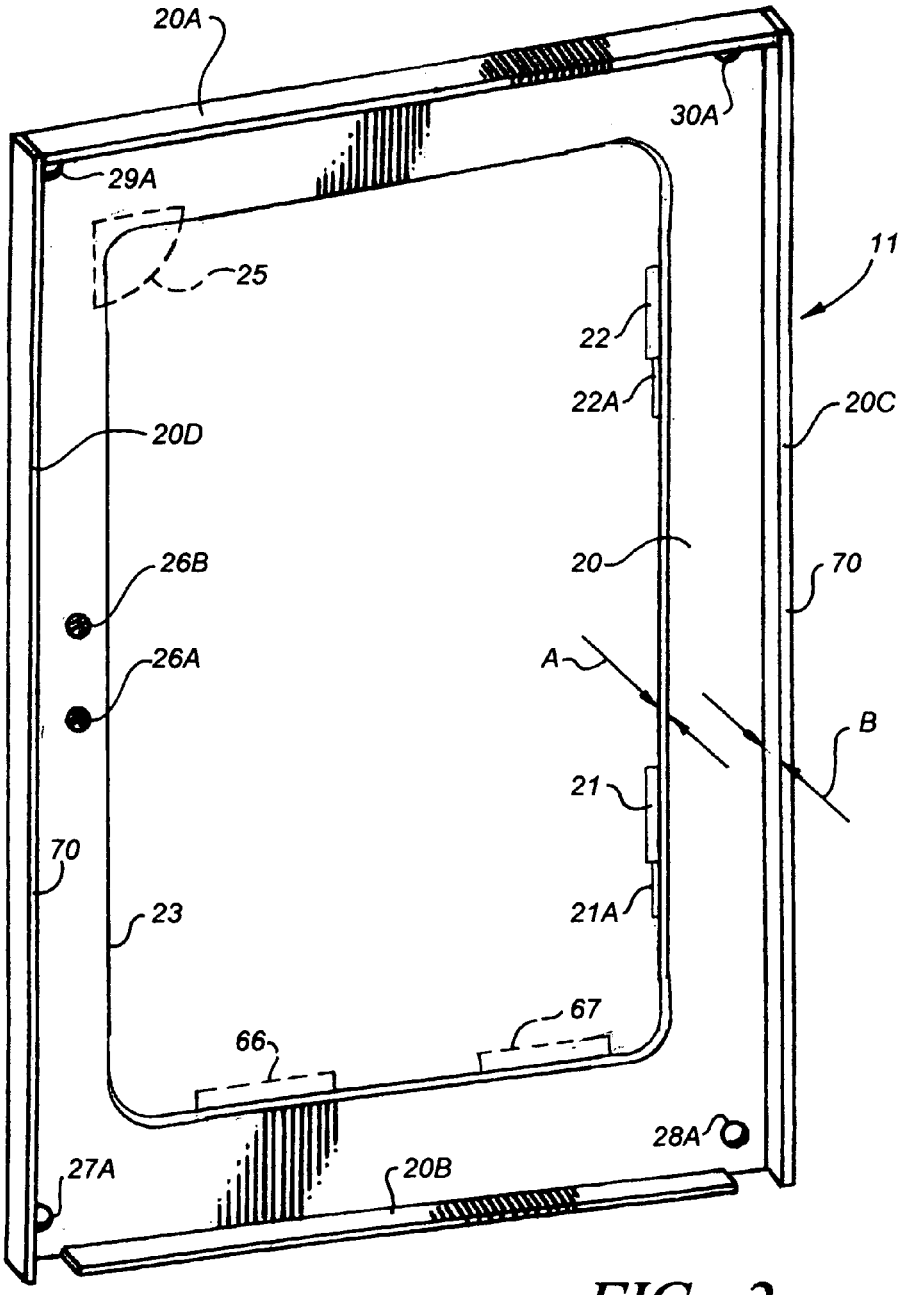
FIG. 2 is a rear perspective view of the security member of FIG. 1 illustrating further construction details thereof.

In FIG. 2, the thickness of panel 20 is indicated by arrows A. Openings 27A, 28A, 29A, 30A each receive a bolt 27, 30 or other fastener that is used to secure panel 20 to wall 50. A bolt passing through an opening 27A, 28A, 29A, 30A into wall 50 preferably also passes through flange 61 to further secure flange 61 to wall 50.

If desired, stops 24, 25 can be incorporated in panel 20 to stop the travel of door panel 12 when door 12 is being moved from an open position (FIG. 4) to a closed position (FIG. 3). It is important in the practice of the invention that panel 20 be near to and preferably directly contact flange 61 to make it more difficult to pry panel 20 away from flange 61. Panel 20 is generally parallel to flange 61. It is also preferred that when the first security member 11 is mounted on wall 50, that lip 70 contact exterior surface 50A (or interior surface 50B as the case may be) to make it more difficult to pry panel 20 away from wall 50.

The hinge construction described herein is also important in the practice of the invention because it makes it difficult to break or disable the hinges to remove door panel 12 from security member 11. Another advantage of the hinge construction illustrated in the drawings is that it enables a user, when latch mechanism 46 is unlocked, to open panel 12 and readily lift panel 12 off hinge joints 21A, 22B.

Although any locking latch mechanism 26, 46 can be utilized in the practice of the invention, in one embodiment of the invention, a low profile latch assembly 46—receiver 26 of the type illustrated in FIGS. 1, 3, and 5 is preferred because it does not utilize a pad lock which can be readily cut with bolt cutters. In a low profile latch assembly, the distance D (FIG. 5) which the lock assembly, including any padlock utilized, extends outwardly from is preferably less than one and one-quarter inch, more preferably less than three-quarters of an inch, and most preferably less than one-half inch. While any lock can be destroyed, a lock which does not utilize an exposed U-shaped arm of the type found on many conventional padlocks is preferred in the practice of the invention and makes penetrating door panel 12 more difficult. In particular, if a latch assembly 46 is provided which utilizes a padlock, a circular or disc shaped padlock with a shrouded shackle is preferred because a smaller portion of the shackle is exposed in comparison to many conventional padlocks in which the entire U-shaped shackle is exposed. Circular disc locks are difficult to open with bolt cutters and opening a circular disc lock (without using the keys or combination that accompanies the lock) typically requires the use of an angle grinder or knowledgeable locksmith. As utilized herein, a latch assembly 46 which uses a circular disc lock comprises a low profile latch assembly 46 as long as the portions of the latch assembly 46 other than the circular disc lock each extend outwardly a distance D of less than one and one-quarter inch, preferably less than three-quarters of an inch, and more preferably less than one-half of an inch.

Having described my invention in such terms as to enable those of skill in the art to make and use the invention, and having described the presently preferred embodiments thereof, I claim:

1. A method to provide in a wall of a building structure a low-profile secure canine access, the wall including an exterior side including a vertically oriented exterior face and an interior side including a vertically oriented interior face, the method comprising the steps of (a) forming an access opening through the wall, said opening extending from said exterior face through the wall to said interior face and having a first peripheral edge, a top, a bottom, and sides extending between said top and said bottom;

(b) providing a door structure mountable in said opening in the wall, said door structure including (i) at least one side sized to extend at least partially through said opening from said exterior face to said interior face, and (ii) a flange (61) connected to said at least one side and shaped and dimensioned to extend substantially around said top, bottom and sides of said opening and laterally away from the opening over and contacting and parallel to a portion of said exterior face of the wall adjacent the opening, said flange having a second peripheral edge spaced away from said opening and a selected thickness such that said flange projects a selected distance outwardly from said exterior face of the wall, and said flange is not inset in said wall;

(c) providing a first security member (11) separate from said door structure and shaped and dimensioned to be mounted on and overlie and enclose said flange and including (i) a generally orthogonal substantially flat frame panel (20) having a third peripheral edge and an outwardly facing first exterior surface, (ii) a generally orthogonal door opening formed through said frame panel, said opening including a top, a bottom, a first side, and a second side, said door opening, frame panel, exterior surface, and third peripheral edge generally lying in a common plane, (iii) at least a pair of spaced apart security hinges each including a base fixedly secured to said frame panel at said first side of said opening, and a hinge joint attached to and outwardly projecting from said base and spaced apart from said frame panel, (iv) a first portion of a manually operable locking latch mechanism on said frame panel at said second side of said opening, (v) an outwardly extending secondary edge (20A, 20B, 20C, 20D) extending substantially the entire distance around, substantially enclosing, connected to and perpendicular to said third peripheral edge of said frame panel, said secondary edge having a width generally equivalent to said thickness of said flange and having a distal lip (70) spaced apart from said frame panel such that said distal lip (70) is not inset in said wall, and, said secondary edge (20A, 20B, 20C, 20D) and frame panel (20) substantially obscure from view said flange and said second peripheral edge from view, (vi) said common plane, said frame panel, said door opening, and said third peripheral edge each being located on said exterior side of said wall and spaced outwardly apart from said exterior face of said wall, (vii) said common plane generally being parallel to and spaced apart from said exterior face, (vii) said secondary edge extending outwardly from said exterior face of said wall;

(d) providing a second security member (12) comprising (i) a generally orthogonal door panel having top, a second exterior surface, bottom and side edges, and at least two operative positions, a first operative closed position, and a second operative open position, said door panel shaped and dimensioned to fit in, substantially fill, conform to, and be flush with said door opening in said first operative position such that said top edge is adjacent said top of said door opening, said first exterior surface is flush with said second exterior surface and lies in said common plane, said bottom edge is adjacent said bottom of said door opening, and each of said side edges is adjacent a different one of said first and second sides of said door opening, (ii) at least a pair of spaced apart hollow security hinge members each operatively associated with a different one of said security hinges, fixedly secured to said door panel, shaped and dimensioned to be removably mounted on a different one of said hinge joints by sliding rotatably downwardly over said different one of said hinge joints and substantially completely cover and enclose said different one of said hinge joints, (iii) a second portion of said manually operable locking latch mechanism, said locking latch mechanism having a first operative open locked configuration in which said second portion engages said first portion and said door panel is locked in a closed position and a second operative unlocked configuration in which said door panel can freely pivot on said hinge joints to an open position, said door panel, when mounted flush with said frame panel (20), being on said exterior side of said wall and spaced outwardly apart from said exterior face of said wall, said flange, first security member, and second security member each not being inset in said wall and being positioned on said exterior side of said wall;

(e) mounting said door structure in said opening with said flange adjacent and contacting the exterior face of the wall;

(f) mounting said first security member on the exterior face of the wall with (i) said frame panel extending over and adjacent said flange, (ii) said lip circumscribing, enclosing, and adjacent said second peripheral edge of said flange and adjacent and contacting the exterior face of the wall, (iii) said door opening generally in registration with said first peripheral edge of said access opening, and, (iv) said door opening, frame panel, and common plane on said exterior side of said wall and spaced outwardly apart from said exterior face;

(g) mounting said second security member on said first security member by sliding said security hinge members over said hinge joints; and, (h) closing said door panel by pivoting said door panel on said hinge joints to move said door panel into registration and flush with said door opening;

(i) manually operating said latch mechanism into said second locked configuration.

2. The method of claim 1 including the additional step of inserting fasteners which extend through said third peripheral edge and flange into said wall, said fasteners forcing said third peripheral edge and flange in a common direction toward said exterior face.

* * * * *